US008844770B2

(12) United States Patent
Jourdin et al.

(10) Patent No.: US 8,844,770 B2
(45) Date of Patent: Sep. 30, 2014

(54) COVER MEMBER, METHOD OF PRODUCING ONE SUCH MEMBER AND A FLUID PRODUCT DISPENSER USING ONE SUCH MEMBER

(75) Inventors: Gilles Jourdin, Combon (FR); Cédric Mesnil, La Neuville du Bosc (FR)

(73) Assignee: Aptar France SAS, Le Neubourg (FR)

( * ) Notice: Subject to any disclaimer, the term of this patent is extended or adjusted under 35 U.S.C. 154(b) by 1129 days.

(21) Appl. No.: 12/089,116

(22) PCT Filed: Oct. 2, 2006

(86) PCT No.: PCT/FR2006/050969

§ 371 (c)(1),
(2), (4) Date: Jul. 9, 2008

(87) PCT Pub. No.: WO2007/042701

PCT Pub. Date: Apr. 19, 2007

(65) Prior Publication Data

US 2009/0224005 A1 Sep. 10, 2009

(30) Foreign Application Priority Data

Oct. 4, 2005 (FR) ..... 05 10152

(51) Int. Cl.
*B67B 1/00* (2006.01)
*B05B 11/00* (2006.01)

(52) U.S. Cl.
CPC ..... *B05B 11/3049* (2013.01); *B05B 11/3047* (2013.01)
USPC ..... 222/153.1; 222/321.9; 222/153.09; 222/319; 215/274; 215/277

(58) Field of Classification Search
USPC ..... 215/274, 277; 222/321.9, 153.09, 222/153.1, 319; 292/1, 80
See application file for complete search history.

(56) References Cited

U.S. PATENT DOCUMENTS 613,371 A 11/1898 Hoffman et al.
649,453 A 5/1900 Hoffman
(Continued)

FOREIGN PATENT DOCUMENTS

DE 20 2004 000 921 U1 6/2005
EP 0 704 250 A2 4/1996
(Continued)

OTHER PUBLICATIONS

European Search Report for EP 06 01 9267, dated Jan. 23, 2008.
(Continued)

*Primary Examiner* — Jason Boeckmann
*Assistant Examiner* — Joel Zhou
(74) *Attorney, Agent, or Firm* — Sughrue Mion, PLLC

(57) ABSTRACT

A covering member (1; 1'; 1") for mounting on a fastener ring (2), the ring and the covering member co-operating with each other to form a fastener device for fastening a dispenser system (3), such as a pump or a valve, on a receptacle neck (40), the covering member presenting a general configuration that is substantially cylindrical and that includes an outside wall (14) and an inside wall (15) for coming into clamping contact around the ring (2), the inside wall forming projections (17) that project inwards from a base zone (151), the projections being disposed as elongate ribs (16; 16'; 16"), the covering member being characterized in that each rib is formed by a plurality of projections (17) that are separated by gaps (18) in such a manner as to form a projecting rib that is interrupted locally.

14 Claims, 4 Drawing Sheets

(56) References Cited

U.S. PATENT DOCUMENTS 651,369 A 6/1900 Lindemeyr
910,128 A 1/1909 Hammer
942,141 A 12/1909 Hoffman
1,116,241 A 11/1914 Carlson
1,353,399 A 9/1920 Ingram et al.
1,386,729 A 8/1921 Ramsey
1,386,742 A 8/1921 Taliaferro
1,427,683 A 8/1922 Greenewald
1,464,584 A 8/1923 Ramsey
1,590,517 A 6/1926 Jacobs
1,720,835 A 7/1929 Holmdahl
1,776,528 A 9/1930 Unke
RE18,184 E 9/1931 Brown et al.
1,853,946 A 4/1932 Unke
1,882,995 A 10/1932 Scofield
1,965,713 A 7/1934 Shaw
1,974,251 A 9/1934 Reutter
1,974,252 A 9/1934 O'L Killorin
2,125,790 A 8/1938 Johnson
2,223,202 A 11/1940 Bergan
2,251,897 A 8/1941 Severn
2,304,826 A 12/1942 Jackson
2,543,960 A 3/1951 Elmer
2,632,478 A 3/1953 Ronfeldt
2,726,001 A 12/1955 Cululi
2,853,047 A 9/1958 Berisch et al.
2,980,274 A 4/1961 Gould
2,990,079 A 6/1961 Garvey
3,069,040 A 12/1962 Corsette
3,343,252 A 9/1967 Reesor
3,503,534 A 3/1970 Moller
3,516,572 A 6/1970 Davis
3,589,544 A 6/1971 Hannon
3,592,499 A 7/1971 Nelson et al.
3,631,650 A 1/1972 Leftault, Jr.
3,648,874 A 3/1972 Moller
3,682,345 A 8/1972 Baugh
3,690,495 A 9/1972 Turner
3,812,741 A 5/1974 Heine
3,854,371 A 12/1974 Lamothe
3,868,038 A 2/1975 Hadley
3,885,696 A 5/1975 Eberhardt
3,963,120 A 6/1976 Perfect
4,006,836 A 2/1977 Micallef
4,058,031 A 11/1977 Magarian
4,119,121 A 10/1978 Smiley
4,223,793 A 9/1980 Patton
4,241,864 A 12/1980 Kessler
4,366,921 A 1/1983 Kirk, Jr.
4,382,521 A 5/1983 Ostrowsky
4,399,092 A 8/1983 Snow, Sr. et al.
4,427,126 A 1/1984 Ostrowsky
4,456,137 A 6/1984 Lyman
4,461,394 A 7/1984 Sendel et al.
4,485,934 A 12/1984 Maguire
4,500,006 A 2/1985 Lafortune et al.
4,501,301 A 2/1985 Snow, Sr. et al.
4,509,654 A 4/1985 Maguire
4,553,567 A 11/1985 Telander
4,645,087 A 2/1987 Kusz
4,655,256 A 4/1987 Lasota et al.
4,669,620 A 6/1987 Coifman
4,704,924 A * 11/1987 Echols ..... 81/3.4
4,709,825 A 12/1987 Mumford
4,717,034 A 1/1988 Mumford
4,721,220 A 1/1988 Northup
4,738,370 A 4/1988 Urmston et al.
4,747,502 A 5/1988 Luenser
4,773,553 A 9/1988 Van Brocklin
4,828,130 A 5/1989 Hofmann
4,997,097 A 3/1991 Krautkramer
5,004,112 A 4/1991 McBride
5,044,521 A 9/1991 Peckels
5,158,180 A 10/1992 Zucker
5,176,269 A 1/1993 Herman
5,192,006 A 3/1993 Van Brocklin et al.
5,195,562 A 3/1993 Dreyfuss et al.
5,197,620 A 3/1993 Gregory
5,244,015 A 9/1993 Dreyfuss et al.
5,314,084 A 5/1994 Folta et al.
5,356,021 A 10/1994 McBride et al.
5,398,830 A 3/1995 de Pous et al.
5,562,219 A 10/1996 de Pous et al.
5,673,809 A 10/1997 Ohmi et al.
5,676,269 A 10/1997 Blake et al.
5,678,720 A 10/1997 Van Melle
5,704,400 A 1/1998 Eldridge
5,762,217 A 6/1998 Ohmi et al.
5,775,528 A 7/1998 Wohlgemuth et al.
5,791,504 A 8/1998 Hofmann et al.
5,799,810 A 9/1998 de Pous et al.
5,819,805 A 10/1998 Mosing et al.
5,836,468 A 11/1998 Bosl et al.
5,853,093 A 12/1998 Neiger
5,927,529 A 7/1999 Hofmann et al.
5,957,315 A 9/1999 Kaitsuka
5,960,972 A 10/1999 Larguia, Sr.
5,975,369 A 11/1999 Yurkewicz et al.
6,006,930 A 12/1999 Dreyer et al.
6,056,136 A 5/2000 Taber et al.
6,089,390 A * 7/2000 Druitt et al. ..... 215/252
6,109,466 A 8/2000 Carrier
6,116,443 A 9/2000 Parrinello
6,116,448 A 9/2000 Fragos
6,123,212 A 9/2000 Russell et al.
6,186,359 B1 2/2001 de Pous et al.
6,253,941 B1 * 7/2001 VanBrocklin et al. ..... 215/274
6,276,544 B1 8/2001 Battegazzore
6,290,103 B1 9/2001 Fraillon
6,321,924 B1 11/2001 Yurkewicz et al.
6,409,049 B1 6/2002 de Pous et al.
6,491,175 B1 12/2002 Taha
6,527,132 B1 3/2003 Druitt et al.
6,543,648 B2 4/2003 de Pous et al.
6,571,991 B2 6/2003 Jourdin
6,581,792 B1 6/2003 Limanjaya
6,588,614 B2 7/2003 Neuner
6,626,310 B2 9/2003 Taha
6,640,988 B2 11/2003 Taha
6,659,297 B2 12/2003 Gregory et al.
6,695,171 B2 * 2/2004 Walters et al. ..... 222/153.13
6,758,359 B2 7/2004 Yurkewicz et al.
6,772,893 B2 8/2004 Pares Montaner et al.
6,776,311 B2 8/2004 Ackermann
6,929,137 B1 8/2005 Granger et al.
6,935,540 B2 8/2005 Ackermann
6,991,123 B2 1/2006 Druitt et al.
7,011,236 B2 3/2006 VanBrocklin
7,048,140 B1 5/2006 Caldwell
7,111,746 B2 9/2006 Miceli et al.
7,198,757 B2 4/2007 Chiarin
7,207,452 B2 4/2007 Jourdin
7,235,207 B2 6/2007 Gregory et al.
7,431,877 B2 10/2008 Druitt
7,451,899 B2 11/2008 de Pous
7,645,414 B2 1/2010 Gregory et al.
7,703,617 B1 4/2010 Branson et al.
7,757,902 B2 7/2010 Bevans et al.
7,780,043 B2 8/2010 Jourdin et al.
8,051,879 B2 11/2011 Zeyfang
2002/0000420 A1 1/2002 Taha
2002/0047026 A1 4/2002 Jourdin
2002/0100742 A1 8/2002 Jourdin
2002/0125270 A1 9/2002 de Pous et al.
2003/0098285 A1 5/2003 Gregory et al.
2003/0116523 A1 6/2003 Druitt et al.
2003/0231988 A1 * 12/2003 Chiarin ..... 422/99
2004/0099693 A1 5/2004 Ackermann
2004/0124169 A1 7/2004 Gregory et al.

(56) References Cited

U.S. PATENT DOCUMENTS

| | | | | |
|---|---|---|---|---|
| 2004/0195197 | A1 | 10/2004 | Miceli et al. | |
| 2004/0222242 | A1 | 11/2004 | Ackermann | |
| 2006/0070972 | A1 | 4/2006 | Gomer | |
| 2006/0273115 | A1 | 12/2006 | De Pous | |
| 2006/0283830 | A1 | 12/2006 | Jourdin et al. | |
| 2007/0068972 | A1* | 3/2007 | Pleyer | 222/321.9 |
| 2007/0181525 | A1 | 8/2007 | Gregory et al. | |
| 2008/0053948 | A1 | 3/2008 | Bevans et al. | |
| 2008/0296309 | A1 | 12/2008 | Jourdin et al. | |
| 2009/0224005 | A1 | 9/2009 | Jourdin et al. | |
| 2010/0326560 | A1 | 12/2010 | Zeyfang | |

FOREIGN PATENT DOCUMENTS

| | | | |
|---|---|---|---|
| EP | 0 704 251 | A2 | 4/1996 |
| EP | 1 270 434 | A1 | 1/2003 |
| FR | 2.040.666 | A5 | 1/1971 |

OTHER PUBLICATIONS

Office Action dated Mar. 29, 2013, issued by the U.S. Patent and Trademark Office in U.S. Appl. No. 12/089,007.

Office Action dated May 30, 2013, issued by the U.S. Patent and Trademark Office in U.S. Appl. No. 12/089,079.

* cited by examiner

Fig. 3
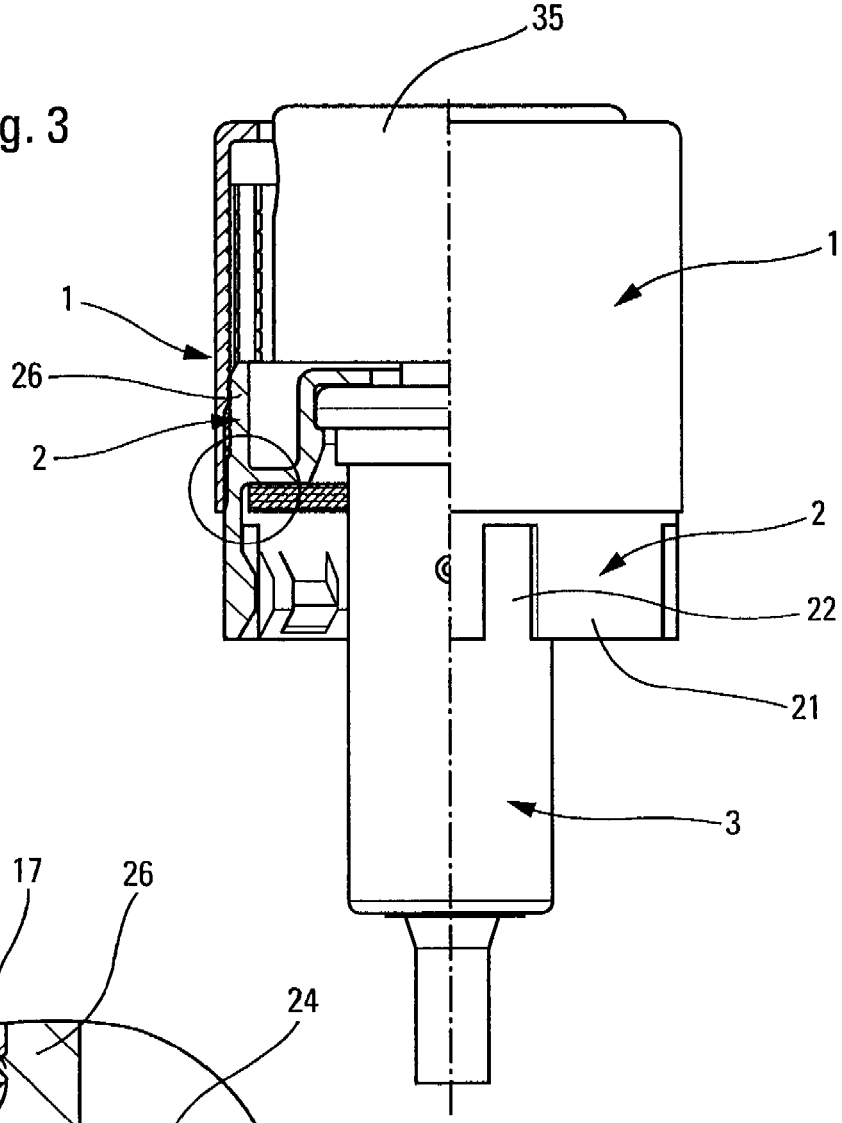
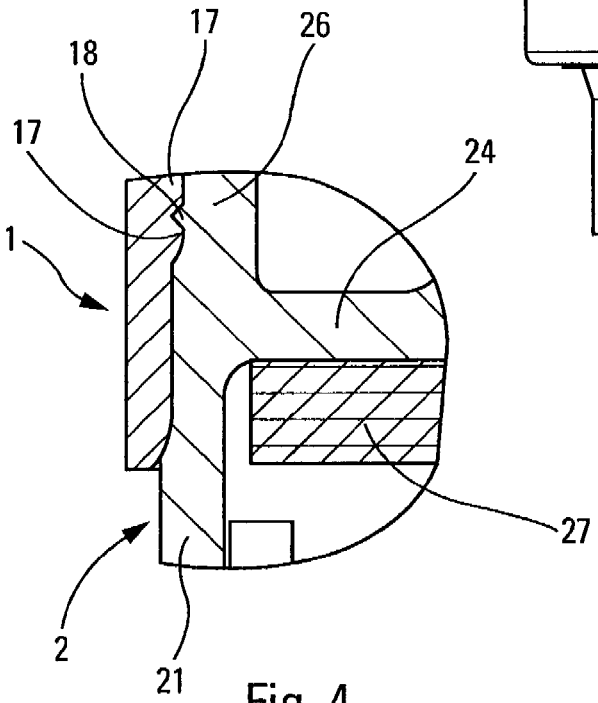
Fig. 4

COVER MEMBER, METHOD OF PRODUCING ONE SUCH MEMBER AND A FLUID PRODUCT DISPENSER USING ONE SUCH MEMBER

The present invention relates to a covering member for mounting on a fastener ring, the ring and the covering member co-operating with each other to form a fastener device for fastening a dispenser system, such as a pump or a valve, on the neck of a receptacle. The present invention also relates to a method of manufacturing the covering member. The present invention also relates to a fluid dispenser comprising a receptacle, a dispenser system (pump or valve), and a fastener device that integrates a covering member of the invention. Such fluid dispensers are frequently used in the fields of perfumery, cosmetics, or even pharmacy.

The covering member of the ring can have technical and/or appearance functions. A first function of the covering member is technical and concerns retaining or blocking the fastener ring on the neck of the receptacle. The covering member can be used to prevent the ring from deforming outwards, and thus from becoming disengaged from the neck of the receptacle. Another function of the covering member concerns appearance and is to cover the fastener ring in such a manner as to impart thereto an attractive appearance. The covering member is thus made with materials and shapes that make it possible to impart thereto an attractive appearance. The covering member may be manufactured out of plastics material or out of metal.

Regardless of whether the covering member fulfils an appearance or a technical function, it is important that it is retained in stationary manner on the fastener ring. It should not be possible to pull the covering member off the ring easily, merely by pulling on said covering member. It is therefore necessary for the fastening between the covering member and the ring to be able to withstand considerable traction. In order to improve the retention of the covering member on the ring, it is already known for the inside wall of the hoop that is to come into clamping contact with the ring to be made with projections that project inwards. In particular, this is the situation in documents EP-0 704 250 and U.S. Pat. No. 6,253,941. In the above-mentioned European document, it is envisaged to form oblique portions in relief on the inside wall of the covering member. The oblique portions in relief make it possible to remove the covering member easily from the hoop for recycling purposes. In the above-mentioned American document, it is envisaged to form annular ribs or grooves on/in the inside wall of the covering member. The grooves or ribs impart good ability to withstand traction, but they are completely ineffective with regard to preventing the covering member from turning.

An object of the present invention is to remedy the above-mentioned drawbacks of the prior art by defining a covering member having considerable ability both to withstand traction and to prevent turning.

To achieve this object, the present invention proposes a covering member for mounting on a fastener ring, the ring and the covering member co-operating with each other to form a fastener device for fastening a dispenser system, such as a pump or a valve, on a receptacle neck, the covering member presenting a general configuration that is substantially cylindrical and that includes an outside wall and an inside wall for coming into clamping contact around the ring, the inside wall forming projections that project inwards from a base zone, the projections being disposed as elongate ribs, each rib being formed by a plurality of projections that are separated by gaps in such a manner as to form a projecting rib that is interrupted locally. In other words, the inside wall of the covering member is provided with projections that are disposed in one or more lines. It is possible to envisage forming a single rib only that extends along a geometrical path (helicoidal, sinusoidal, etc.), or along an irregular path. Naturally, for practical reasons, it is easier to form the ribs in the form of rectilinear lines that extend parallel to one another. By way of example, it is possible to dispose the ribs as substantially vertical splines, i.e. parallel to the axis of the cylindrical covering member. In a variant, it is possible to dispose the ribs substantially horizontally in such a manner as to form annular ribs that are interrupted. It is also possible to form the ribs obliquely in the form of an interrupted screw thread. It is also possible to form ribs that extend in a plurality of different directions, in such a manner as to form rib intersections. The gaps formed between successive projections make it possible to improve the ability to withstand traction and/or turning. For ribs that are disposed vertically, the gaps participate amply in withstanding traction. For horizontal annular ribs, the gaps contribute greatly in preventing turning. For oblique ribs, the gaps participate both in preventing turning and in withstanding traction. The gaps participate in retention as a result of the plastics material constituting the fastener ring creeping into the gaps, thereby forming corresponding blocking points that prevent removal by traction or displacement in turning. Naturally, the projections bite into the plastics material constituting the fastener ring. As a result, increasing the numbers of projections and of gaps makes it possible to obtain considerable retention. In other words, the gaps provide retention in the direction that is substantially perpendicular to the orientation of the ribs.

In an advantageous embodiment, the projections of a rib are elongate in the longitudinal direction of the rib, each projection forming two ends and two long edges, the adjacent ends of two projections being separated by a gap. The long edges provide retention in a given direction, and the ends provide retention in the direction that is perpendicular thereto.

In another practical embodiment, the gaps are made by displacing material, such that each gap is bordered by lumps of displaced material. The lumps of displaced material themselves constitute profiles forming projections or gaps that contribute still further in retaining the covering member on the fastener ring.

The present invention also defines a first method of manufacturing a covering member as defined above, the method comprising the following successive steps: a) making a covering member by stamping metal in such a manner as to form continuous ribs on the inside wall; and b) machining the ribs by removing material so as to form gaps that divide each rib into a plurality of separate projections. The projections and the gaps are thus formed using two different techniques. The only drawback with the technique of machining by removing material is that is generates metal debris or swarf that is difficult to remove completely. Consequently, the present invention proposes another manufacturing method in which the machining step is performed by displacing material and not by removing material. The technique of machining by displacing material has the advantage of not generating any metal debris or swarf. In this event, it is possible to perform the machining step by embossing or by knurling. In addition, this technique generates lumps of displaced material that retain the covering member even more securely on the ring.

The invention also defines a fluid dispenser comprising a receptacle, a dispenser system, and a fastener device that integrates a covering member as defined above.

An advantageous principle of the invention consists in forming an array of discrete or separate projections on the inside wall of the covering member, the projections being separated by gaps that also participate, together with the projections, in retaining the covering member on the fastener ring.

The invention is described more fully below with reference to the drawings that show several embodiments of the invention by way of non-limiting example.

In the drawings:

FIG. 3 is a view corresponding to FIG. 1, but in the mounted state;

FIG. 4 is a very greatly enlarged view of a detail of FIG. 3;

Figures 1, 2:
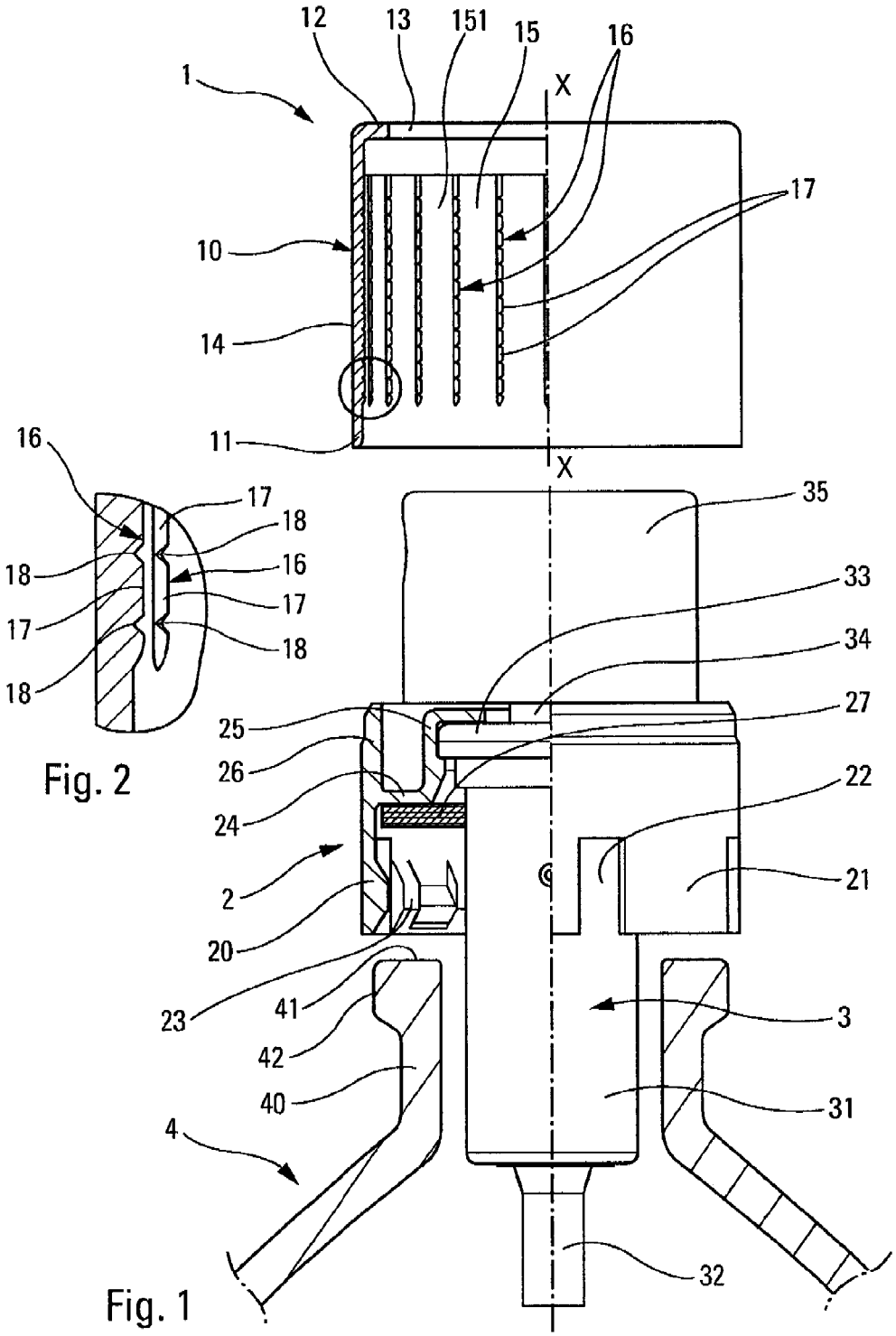
FIG. 1 is an exploded view, partially in section and partially in plan, of a fluid dispenser implementing a covering member constituting a first embodiment of the invention.
FIG. 2 is a very greatly enlarged view of a detail of FIG. 1.

In the embodiments used to illustrate the present invention, the covering member fulfils both technical and appearance functions. The covering member constitutes a member that is visible from the outside, and that consequently imparts an attractive appearance. This is why the covering member is designated in the following description by a term that is frequently used in the fields of perfumery and cosmetics, namely a "covering hoop". The term "covering" is particularly appropriate, given that the hoop covers the fastener ring, as can be seen below.

Reference is made initially to FIGS. 1 to 6 in order to explain in detail the first embodiment of a covering hoop of the invention. The hoop is designated overall by numerical reference 1. The hoop can be made of plastics material or of metal. It presents a general configuration that is substantially cylindrical with a hollow inside. More precisely, the hoop comprises a tube 10 that is substantially cylindrical, and that includes a bottom end 11, and a top end that extends inwards in the form of an inwardly-directed rim 12. The edge of the inwardly-directed rim 12 defines an opening 13 that leads into the tube 10. The tube 10 includes a visible outside wall 14 and an inside wall 15.

Figure 6:
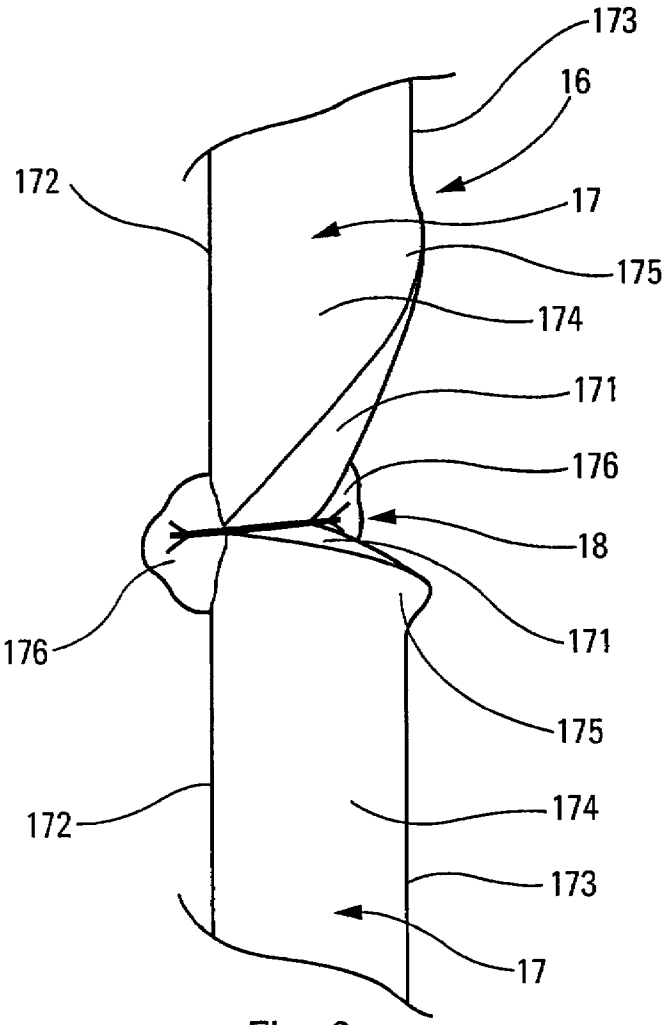
FIGS. 5 and 6 are very greatly enlarged views each showing two projections separated by a gap, and each constituting a variant embodiment.
Figure 5:
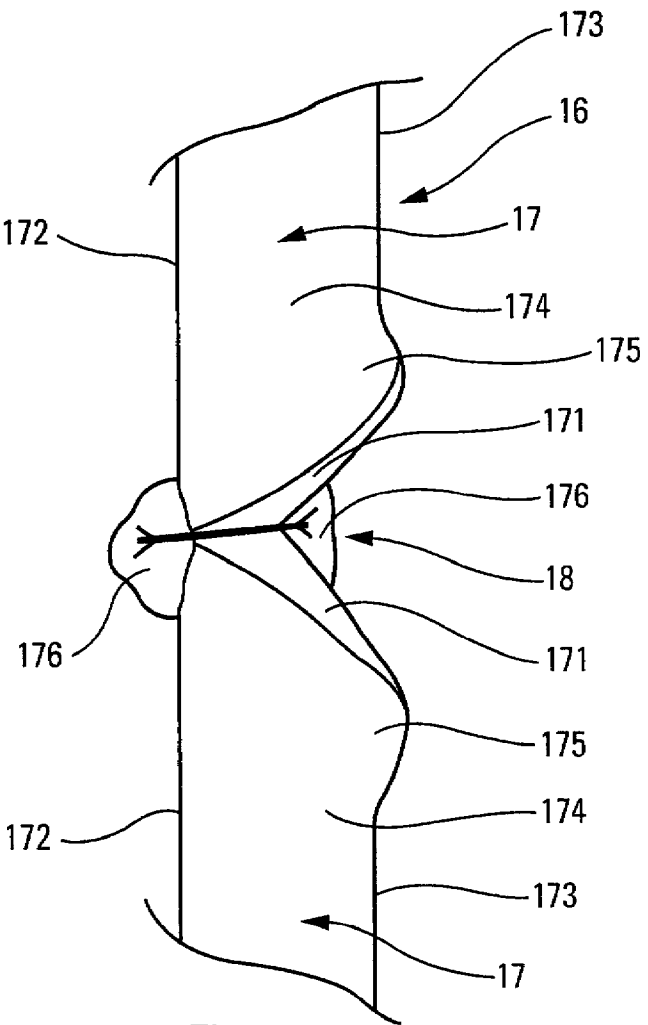

In the invention, the inside wall 15 is provided with projections that project inwards from a cylindrical base zone 151. The projections 17 are advantageously disposed as elongate ribs 16 that extend as vertical splines, i.e. parallel to the axis X of the cylinder formed by the tube 10. The inside wall 15 of the tube 10 is thus provided with twenty-four ribs 16 in the first embodiment. The ribs 16 extend parallel to one another, and are distributed over the wall in equidistant manner. Another disposition is also possible. The number of ribs can also vary. With reference to FIG. 2, it can be seen that each rib 16 comprises a plurality of projections 17 that are separated by gaps 18. The projections 17 present an elongate configuration that lies in the same longitudinal direction as the ribs 16. Each projection thus forms two ends 171 and two long edges 172, as can be seen in FIGS. 5 and 6, that are described in greater detail below. It is also possible to form the projections with a configuration that is less elongate, such that each projection generally forms a dot. Each rib can be likened to a dotted or discontinuous line having dots that are constituted by the projecting projections.

A characteristic of this first embodiment resides in the fact that the ribs 16 are vertical, i.e. they extend parallel to the axis of the cylinder formed by the tube 10. Advantageously, the ribs 16 do not extend as far as the bottom end 11, but start a little higher, leaving a bottom segment that does not have ribs. The same applies for the top end of the tube 10 that also does not have ribs.

The covering hoop 1 is for co-operating with a fastener ring 2 that presents a configuration that is entirely conventional for the fields of perfumery and of cosmetics. The ring 2 is preferably made of plastics material. The fastener ring 2 includes a skirt 20 defining tabs 21 that are separated by vertical longitudinal slots 22. Each tab 21 internally forms catches 23 that project inwards. The tabs 21 are separated by the slots 22 in such a manner as to impart to the tabs, a capacity for deformation that is necessary in order to engage the ring on the neck. At its top end, the skirt 20 is connected to a plate 24 that extends inwards forming a snap-fastener housing 25 having a function that is explained below. In addition, the ring 2 includes a guide wall 26 that advantageously extends upwards in alignment with the skirt 20.

A dispenser system 3, specifically a pump, is engaged in the snap-fastener housing 25 of the ring 2. The pump 3 includes a body 31 defining an inlet 32 at its bottom end, and a collar 33 at its top end, which collar is engaged by snap-fastening inside the housing 25. The pump 3 also includes an actuator rod 34 that is movable downwards and upwards inside the body 3. The actuator rod 34 projects out from the body and receives an actuator head 35 that is in the form of a pusher. Thus, by pressing on the pusher 35, the actuator rod 34 is moved inside the body 31, thereby dispensing a dose of fluid. This pump is entirely conventional in the fields of pharmacy or of cosmetics.

As mentioned above, the ring 2 is for fastening the pump 3 on a receptacle that is designated by the numerical reference 4. The receptacle, that is shown only in part, includes a neck 40 that defines an opening that puts the inside of the receptacle into communication with the outside. The neck 40 defines an annular top end edge 41 and an outer peripheral shoulder 42. The fastener ring 2 co-operates with the neck by engaging the catches 23 below the shoulder 42. In order to achieve sealing, a neck gasket 27 is compressed between the top edge 41, and the plate 24 of the ring 2. To get below the shoulder 42, the catches 23 must firstly pass beyond the shoulder 42. This is possible as a result of the tabs 21 being able to deform radially outwards so as to pass over the shoulder 42. After passing over the shoulder, the catches 23 can be received, at least in part, below the shoulder 42. In entirely conventional manner, the covering hoop 1 is mounted on the fastener ring 2 in such a manner as to block the tabs 21 around the neck 40. To do this, the inside wall 15 of the covering hoop comes into clamping contact with the outside wall of the ring that is formed by the skirt 20 and by the guide wall 26.

For the hoop constituting the first embodiment, the projections 17 bite into the plastics material constituting the ring 2. To this end, it is necessary for the inside diameter of the envelope defined by the tops of the projections 17 to be less than the outside diameter of the ring at the skirt 20 and/or at the guide wall 26. In FIG. 3, it can be seen that the covering hoop 1 is engaged, in part, on the ring 2, i.e. over the guide wall 26 only. With reference to FIG. 4 that shows a detail of FIG. 3 on a larger scale, it can be seen that the projections 17 bite into the material constituting the ring 2. In the final position (not shown), the hoop 1 completely surrounds the ring 2, with the bottom end 11 of the hoop being situated below the bottom end of the ring, and the inwardly-directed rim bearing against the top end of the guide wall 26. In this final assembly position, the ribs 16 constituted by the projections 17 and the gaps 18, bite into the skirt 20 and the guide wall 26 over practically their entire height.

The vertical disposition of the ribs 16 enables the hoop to be engaged more easily around the ring by penetrating into the material constituting the ring like a blade. The material constituting the hoop is preferably harder than the material of the ring. The vertical disposition of the ribs prevents any turning of the hoop about the ring. For the most part, this prevention from turning is provided by the projections 17. In the invention, the gaps 18 also participate in retaining the hoop on the ring, mainly with regard to withstanding traction, making it possible to prevent the hoop from being removed from the ring by pulling on said hoop. The creep qualities of plastics material have been well known for a long time. Such creep characteristics enable the plastics material constituting the ring to creep into the gaps 18 defined between successive projections 17. It can also be said that the plastics material creeps around each projection, i.e. around its long edges 172, and also around its ends 171. The substantially perpendicular orientation of the ends relative to the edges thus provides good ability to withstand both turning and traction. This does not apply with continuous ribs as in the above-mentioned prior art documents.

Such locally-interrupted projecting ribs can be made in various ways. For example, it is possible to form the projections during a single manufacturing step, e.g. by molding a plastics material. It suffices to provide a mold cavity that is suitable for making projections that are separated by gaps. It is also possible to make such a hoop out of metal in a single manufacturing step, e.g. by molding, although this is not very practical. The hoop of the invention is advantageously made in two successive steps, namely a first step consisting in making a hoop by stamping metal in such a manner as to form continuous ribs on the inside wall, then machining the ribs by removing material or displacing material so as to form gaps dividing each rib into a plurality of separate projections. In brief, a hoop is manufactured with ribs that are continuous, and then the ribs are modified so as to obtain projections that are separate. The technique of machining by displacing material is preferred, given that it generates neither metal debris nor swarf. By way of example, it is possible to use embossing or knurling techniques to machine the ribs by displacing material. FIGS. 5 and 6 are very greatly enlarged views of ribs that are machined by displacing material. Each figure shows two projections 17 that are separated by a gap 18. As mentioned above, each projection 17 comprises two opposite ends 171 that are interconnected by two edges 172. Each projection extends from the cylindrical base zone 151 defined by the inside wall 15. The rib 17 thus projects inwards forming two flanks 174 that converge towards a crest 173. The projection 17 thus presents a substantially triangular section in the form of a screw thread. This shape enables better penetration by cutting into the material constituting the fastener ring. The ends 171 of two adjacent projections 17 face each other and thus define a gap 18. The bottom of the gap 18 can lie at the same level as the base zone 151 or at a different level that is higher or lower. Given that the gap 18 is obtained by displacing material, e.g. by embossing or by knurling, the gap 18 is bordered by lumps of displaced material that is concentrated mainly at the crest 173 and at the edges 172. In particular, it can be seen in FIGS. 5 and 6 that the projections 17 form a bulge where the ends 171 meet the crests 173. The bulge is obtained as a result of the material that was previously situated in the gap 18, being displaced over the sides. The same applies for the lumps 176 that extend at the edge 172 at each end of the bottom of the gap. The lumps of displaced material 175 and 176 form corresponding projecting profiles that enable the hoop to be retained even more securely on the ring. In the embodiment in FIG. 5, the gap 18 is substantially symmetrical, such that the ends 171 are identical. In the embodiment in FIG. 6, the gap 18 is asymmetrical with the end 171 of the lower projection 17 lying practically in a horizontal plane, whereas the end 171 of the upper projection 17 lies in a plane that is more vertical. Thus, while the hoop is being driven onto the ring, the plastics material of the ring slides over the end 171 of the upper projection, and when it is desired to remove the hoop from the ring by traction, the material of the ring comes into abutment on the end 171 of the lower projection, which end extends practically perpendicularly to the traction axis. With the asymmetrical gap 18 in FIG. 6, a barb-type fastening function is achieved, making insertion easier and preventing extraction. Naturally, it is possible to imagine other shapes for the gaps 18 that separate two projections 17. As a function of the shape of the gap, the lumps of displaced material are different, as can be seen in FIGS. 5 and 6.

Figure 7:
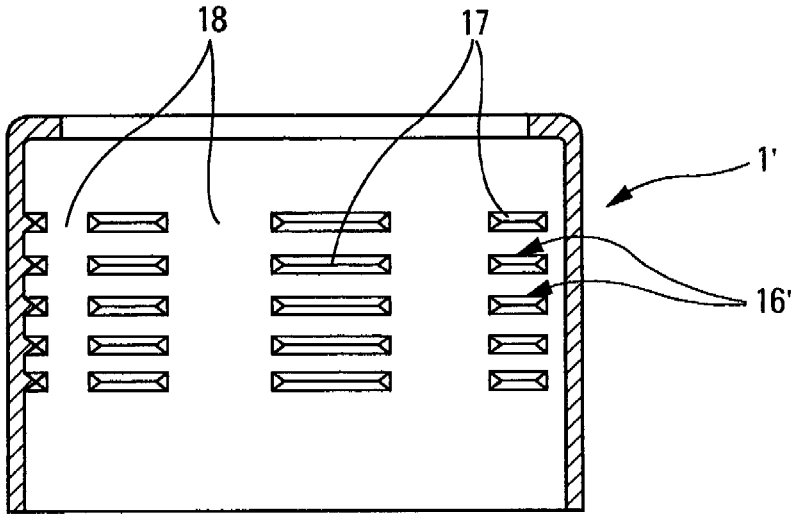
FIGS. 7 and 8 are section views of two covering members constituting two further embodiments of the invention.

FIG. 7 shows another embodiment of a hoop 1' of the invention, in which the ribs 16' extend horizontally in such a manner as to form annular ribs that are locally interrupted by elongate gaps 18 that can also be formed using any technique. The ribs 16' are very good at withstanding traction, while the gaps 18 prevent any turning. In other words, the projections and the elongate gaps alternate regularly.

Figure 8:
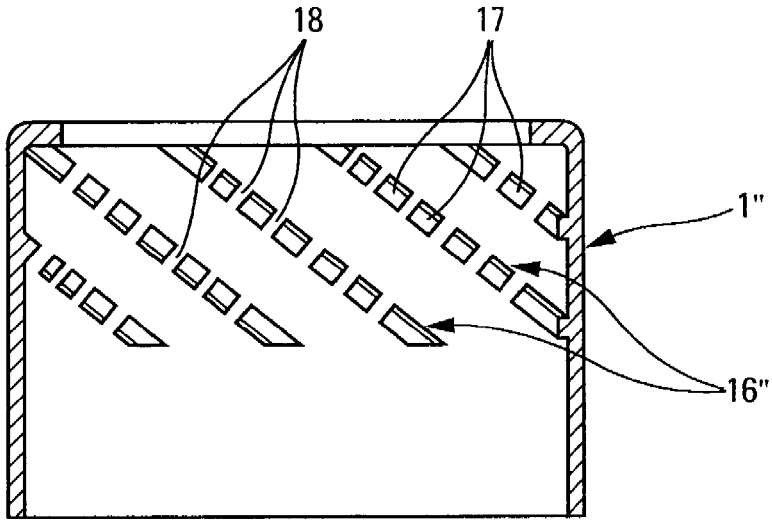

FIG. 8 shows another embodiment for a covering hoop of the invention. The covering hoop 1" includes oblique ribs 16" that extend parallel to one another. The angle of the oblique ribs 16" relative to the longitudinal axis of the hoop is about 45°. It can be seen in FIG. 8 that the ribs 16" are formed by projections 17 that are separated by gaps 18. The gaps 18 can be formed using any technique, e.g. by molding, or by removing or displacing material. As a result of the inclined orientation of the projections 17, said projections are disposed in a lozenge configuration relative to the longitudinal axis of the hoop. This lozenge disposition provides good ability to withstand both turning and traction. The gaps 18 are made perpendicularly to the longitudinal direction of the ribs, but the gaps 18 could also be made perpendicularly to the longitudinal axis of the cylinder, such that each projection presents the shape of a parallelogram.

A principle of the invention can be seen in the fact of forming localized, dot-shaped, or discrete projections on the inside wall of a covering hoop, or more generally on a covering member, for engaging around a fastener ring of a pump or a valve.

The invention claimed is:

1. A fastener device comprising a fastener ring (2) and a covering member (1; 1'; 1") for mounting on the fastener ring (2), the ring configured to be engaged around a receptacle neck (40) for fastening a dispenser system (3), the covering member presenting a general configuration that is substantially cylindrical and that includes an outside wall (14) and an inside wall (15) for coming into clamping contact around the ring (2), the inside wall forming projections (17) that project inwards from a base zone (151) that is cylindrical, the projections are disposed as elongate vertical ribs (16; 16'; 16") oriented relative to an upright orientation of the receptacle and substantially parallel to an axial direction of the covering member, each rib being formed by a plurality of vertically elongate projections (17) that are separated by gaps (18) in such a manner as to form a projecting rib that is interrupted locally and extending vertically and wherein the ribs extend parallel to each other.

2. A covering member according to claim 1, in which the projections (17) of the rib are vertically elongate relative to the upright orientation of the receptacle in the longitudinal direction of the rib, each of the projections forming two ends (171) and two long vertical edges (172), the adjacent ends of two projections being separated by a gap (18).

3. A covering member according to claim 1, in which the gaps (18) are made by displacing material, such that each gap is bordered by lumps of displaced material (175, 176).

4. A method of manufacturing a covering member according to claim 1, the method comprising the following successive steps:

a) making a covering member by stamping metal in such a manner as to form continuous ribs on the inside wall; and b) machining the ribs by removing material so as to form gaps that divide each rib into a plurality of separate projections.

5. A method of manufacturing a covering member according to claim 3, the method comprising the following successive steps:

a) making a covering member by stamping metal in such a manner as to form continuous ribs on the inside wall; and b) machining the ribs by displacing material so as to form gaps that divide each rib into a plurality of separate projections.

6. A method according to claim 5, in which the machining step is performed by embossing or by knurling.

7. A fluid dispenser comprising a receptacle, a dispenser system, and a fastener device that integrates a covering member according to claim 1.

8. The covering member according to claim 1, wherein the plurality of projections that form each rib extend serially one after the other to define a linear track that makes up the rib.

9. The covering member according to claim 1, wherein the plurality of projections that makes up one of the ribs is non-annular.

10. The covering member according to claim 1, wherein the plurality of projections that makes up one of the ribs are broken longitudinally to form the gaps.

11. The covering member according to claim 1, wherein the dispenser system is a pump or a valve.

12. A fastener for fastening a dispenser system to a receptacle, comprising: a fastener ring; a covering member configured to mount on the fastener ring; the fastener ring-configured to engage around a neck of the receptacle to fasten the dispenser system to the receptacle; the covering member comprises an outside wall and an inside wall sized so that the inside wall engages and clamps around an outer surface of the fastener ring; the inside wall of the covering member comprising projections that project from a base zone, the projections are elongated with a length longer than a width and oriented vertically along the length relative to an upright orientation of the receptacle, groups of the projections are disposed vertically one after another with gaps between vertically adjacent projections, each group of projections forming a vertically oriented rib interrupted locally by the gaps, the rib extending parallel to each other and to an axial direction of the covering member.

13. The fastener according to claim 12, wherein the ribs extend parallel to each other along the circumference of the inside wall of the covering member.

14. The fastener according to claim 12, wherein the gaps provide axial retention of the covering member as a result of material from the fastener ring creeping into the gaps.

* * * * *